US006174052B1

(12) United States Patent
Eremity et al.

(10) Patent No.: US 6,174,052 B1
(45) Date of Patent: Jan. 16, 2001

(54) SELF-PRIMING SYSTEM FOR INK JET PRINTERS

(75) Inventors: Frank Eremity, Streamwood; George H. Dick, Chicago, both of IL (US)

(73) Assignee: Marconi Data Systems Inc., Wood Dale, IL (US)

( * ) Notice: Under 35 U.S.C. 154(b), the term of this patent shall be extended for 0 days.

(21) Appl. No.: 09/187,964

(22) Filed: Nov. 6, 1998

Related U.S. Application Data

(63) Continuation-in-part of application No. 08/904,658, filed on Aug. 1, 1997, now abandoned.

(51) Int. Cl.[7] ..... B41J 2/07
(52) U.S. Cl. ..... 347/74; 347/29; 347/35
(58) Field of Search ..... 347/28, 29, 35, 347/74

(56) References Cited

U.S. PATENT DOCUMENTS

| | | | | |
|---|---|---|---|---|
| 3,661,304 | * | 5/1972 | Martinez et al. | 222/394 |
| 3,929,071 | | 12/1975 | Cialone et al. . | |
| 4,520,366 | | 5/1985 | Cragin, Jr. . | |
| 4,614,948 | | 9/1986 | Katerberg et al. . | |
| 4,769,658 | * | 9/1988 | Oda et al. | 347/21 |
| 4,910,529 | | 3/1990 | Regnault . | |
| 4,970,527 | * | 11/1990 | Gatten | 347/23 |
| 4,998,115 | * | 3/1991 | Nevarez et al. | 347/35 |
| 5,412,411 | * | 5/1995 | Anderson | 347/28 |
| 5,572,243 | * | 11/1996 | Hermanson | 347/29 |

FOREIGN PATENT DOCUMENTS

| | | | |
|---|---|---|---|
| 2553341 | | 10/1993 | (FR) . |
| 0 287 372 | | 10/1988 | (WO) . |
| WO 93/17867 | | 9/1993 | (WO) . |
| WO93/17867 | * | 9/1993 | (WO) 347/28 |

* cited by examiner

*Primary Examiner*—N. Le
*Assistant Examiner*—Shih-wen Hsieh
(74) *Attorney, Agent, or Firm*—Piper Marbury Rudnick & Wolfe

(57) ABSTRACT

A priming system for ink jet printers includes an ink tank, an ink supply line, an ink bypass line and a valving arrangement which alternately permits either pressurized ink to be supplied to a remote printhead for printing purposes or unpressurized ink to be drawn to the printhead by use of a vacuum source applied to the bypass line.

20 Claims, 5 Drawing Sheets

SELF-PRIMING SYSTEM FOR INK JET PRINTERS

CROSS REFERENCE TO RELATED APPLICATIONS

This application is a continuation-in-part of U.S. application Ser. No. 08/904,658 filed Aug. 1, 1997.

BACKGROUND OF THE INTENTION

This invention relates to ink jet printers. More particularly, it relates to continuous jet ink jet printers, which are used for marking alpha-numeric characters and the like on substrates. Typically, these commercial printers are used for applying date codes, place of manufacture codes and related information on products as they are manufactured. Such printers must be versatile, working in fairly hostile industrial environments, and quite reliable as down time is particularly unwelcome as it affects the output of the factory. Such ink jet printers are typically housed in a cabinet at a location some distance removed from the actual site of the printing. A printhead is connected to the printing cabinet by an umbilical duct which carries ink to and from the printhead as well as the electrical signals required to operate the printhead.

When installing a new printer or when servicing the printhead, it is necessary to prime the printer, that is to fill the ink supply line with ink and to remove as much, if not all, of the trapped air as possible. Failure properly to prime and remove air is a major cause of misprinting. Because of the use of the umbilical this priming process and the related purging and cleaning operations can be quite time consuming and presently require substantial manual intervention by a skilled technician as described hereafter. Obviously, the elimination or reduction of this downtime and the requirement for skilled, manual servicing are desirable goals. It is accordingly an object of the present invention to reduce the time and frequency of operator intervention to set up an ink jet printer.

It is a further object of the invention to provide an automated system for self-priming which will remove substantially all of the air entrapped in the ink supply line, valves and nozzles associated with the printhead.

It is a further object of the invention to provide an automated system for priming of an ink jet printer and purging of air.

Another object of the invention is to provide a safer and more efficient method for recovering the fluids used during the cleaning and priming operations. These and other objects of the invention will be apparent from the remaining portion of the specification.

SUMMARY OF THE INVENTION

The printer nozzle valve is fitted with an ink bypass line to a source of vacuum. When it is desired to purge and/or prime the ink supply line and nozzle, the air pressure to, or the pump from, the ink supply tank is turned off and vacuum is applied to the bypass line. This sucks ink or solvent from the ink supply tank through the ink line into the nozzle valve and back to a reservoir for reuse or, alternatively, to an ink trap. Because positive pressure is not used to drive the ink through the system, air is not compressed in the ink line or nozzle where it may become temporarily trapped. In addition, any air which is already present in the ink line, tends to be removed by virtue of the fact that a vacuum is used to draw the fluid through the system. After the purging and priming process is complete, the vacuum source is switched out of the system and air pressure is thereafter used to pressurize the ink supply tank to provide pressurized ink to the nozzle for printing. Alternatively, a pump may be used to pressurize the ink supplied by the ink supply tank. All of this is accomplished without the need for manual disassembly of the printhead. Nor is it necessary manually to realign the ink stream within the printhead as is the case with the prior art procedures.

DETAILED DESCRIPTION OF THE INVENTION

Figure 1:
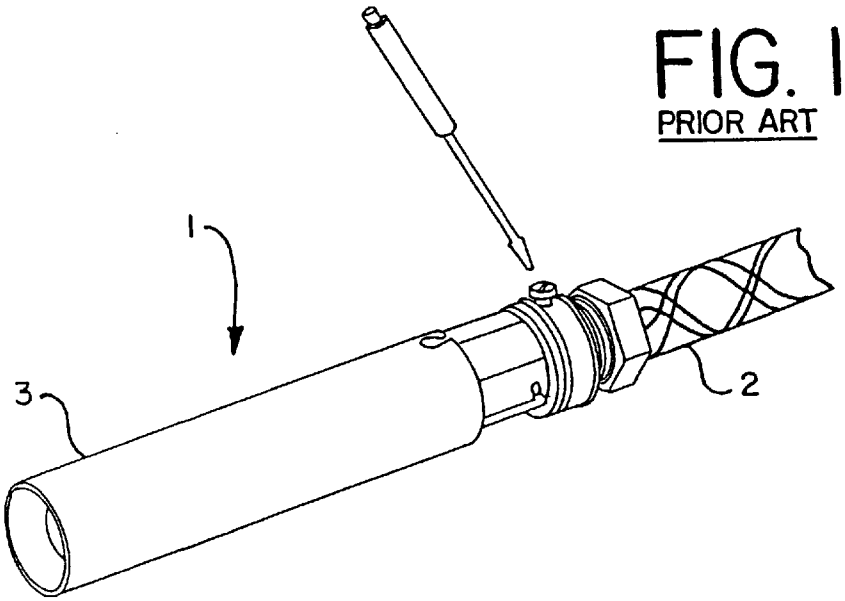
FIG. 1 PRIOR ART
FIG. 1 is a perspective view of a typical ink jet printhead being disassembled to permit manual cleaning and priming.
Figure 2A:
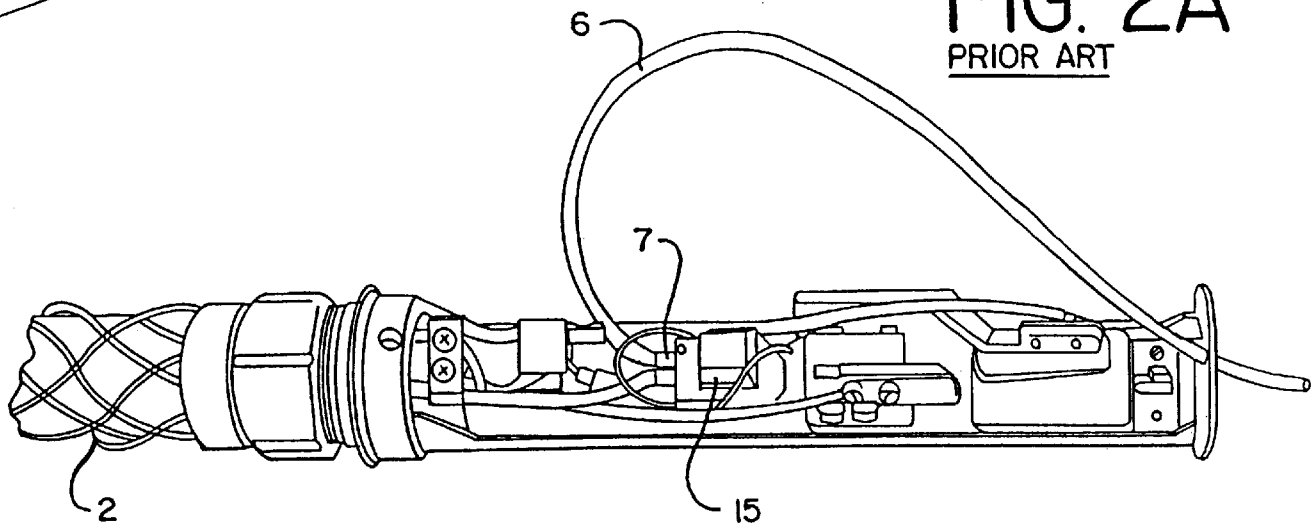
FIG. 2A PRIOR ART
FIG. 2A is a perspective view of the printhead, its cover removed, showing the attachment of a bleed tube to the ink valve for purposes of flushing the printer with cleaning solution prior to priming.
Figure 2:
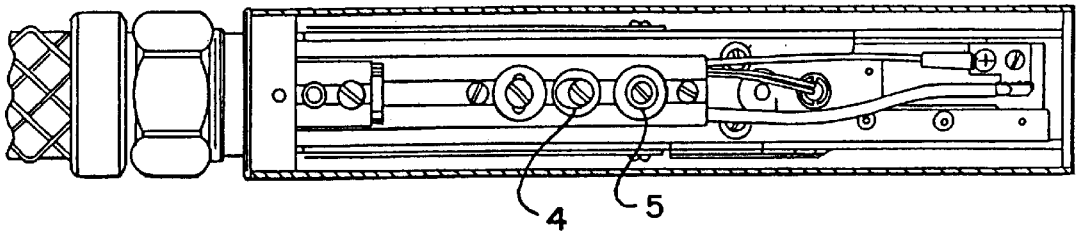
FIG. 2 PRIOR ART
FIG. 2 is a bottom view of the printhead of FIG. 1 showing the manual adjustments which need to be made to prepare the printhead for printing.
Figure 3:
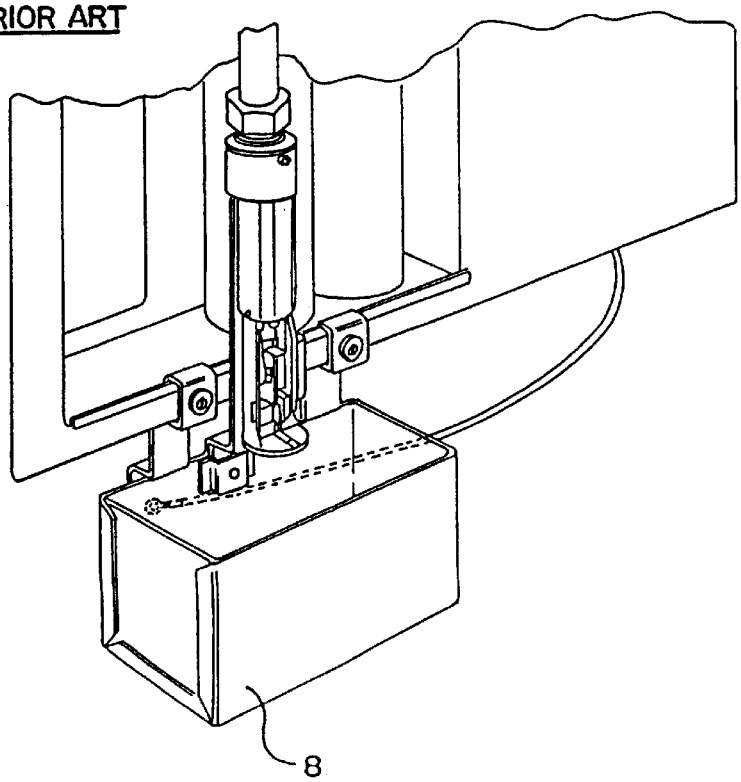
FIG. 3 PRIOR ART
FIG. 3 is a perspective view illustrating the manner in which the flushing and priming procedures are accomplished in the prior art.

As illustrated in FIGS. 1–3, the start-up and priming of a typical ink jet printer requires extensive manual preparation. The printhead 1 is connected to the printer electronics and ink supply by an umbilical 2 in which the ink supply and return lines and electrical wires are contained. A cover 3 is disposed over the printhead. Once the cover is removed, as by the screw shown in FIG. 1, it is possible to service the components of the printhead. Adjustment of the ink stream so that ink drops which are not electrically charged pass into a catcher for return to the ink system, is effected by proper use of adjustment screws 4 and 5 (FIG. 2). When it is desired to purge and/or prime the printer system, thereby to clear the ink supply line of any entrapped air or to prime the system for start up after a major service or upon installation, the printhead cover must be removed and a bleed tube 6 (FIG. 2A) attached to an ink valve bleed port 7 located on the nozzle valve 15. All of these steps are accomplished by a technician who requires a fair degree of skill in order to prepare the printhead for this process without damage to the delicate printhead components. Once the bleed tube has been attached to the nozzle valve bleed port, the system is ready to be purged and/or primed. For that purpose, the printhead is usually positioned as shown in FIG. 3 on a fixture located above a service tray 8 into which the solvent and/or ink is directed during the purging or priming process. During the purging process, cleaning fluid or make-up solution is fed under positive pressure through the ink supply to the nozzle valve bleed port. Thereafter when it is desired to refresh the system, adjustment screw 5 is operated to raise the ink stream above its normal position so that the drops do not enter the catcher. Instead, they are directed into the service tray 8.

Because the umbilical duct supplying the printhead can be from five to twenty-five feet in length, priming the printhead and purging it of air is an important task. In the prior art system as illustrated in FIG. 3, pressurized ink from a reservoir is fed to the nozzle to drive air out of the line. When mostly ink appears at the printhead outlet, the process is stopped. Because the prior art purging process is accomplished by applying ink under positive pressure, air compresses into the pockets inside the various components both in the umbilical duct ink line and the printhead components causing bubbles of air to become trapped. During normal printer operation, this trapped air can dislodge and cause print quality problems and printer faults if they lodge in the nozzle cavity thereby altering the nozzle resonance which is critical to the formation of correctly sized and spaced ink drops.

As is also apparent from FIGS. 1–3, such prior art systems lack a convenient way to capture and recycle the solvent and/or ink used to flush and prime the system. The method illustrated in FIGS. 1–3 can require thirty to sixty minutes to complete depending upon the diameter of the nozzle orifice used in the printhead. After completing a system flush or refresh in present systems, the skilled technician must then take the now primed printhead and realign the ink stream, again using the adjustment screws 4 and 5 so that the stream of uncharged drops will enter the ink catcher at the proper location. This ensures capture of unused drops and also ensures that charged drops will be accurately and properly deflected above the catcher and on to a substrate to be marked. The cover is replaced and the printer placed in service.

In contrast to the prior art techniques illustrated in FIGS. 1–3, the present invention permits purging and priming of an ink jet printer in a considerably shorter time frame, without the need for redirecting fluid away from the catcher and with very little operator intervention. Additionally, because the system priming is performed under vacuum, air entrapment is virtually eliminated.

Figure 4:
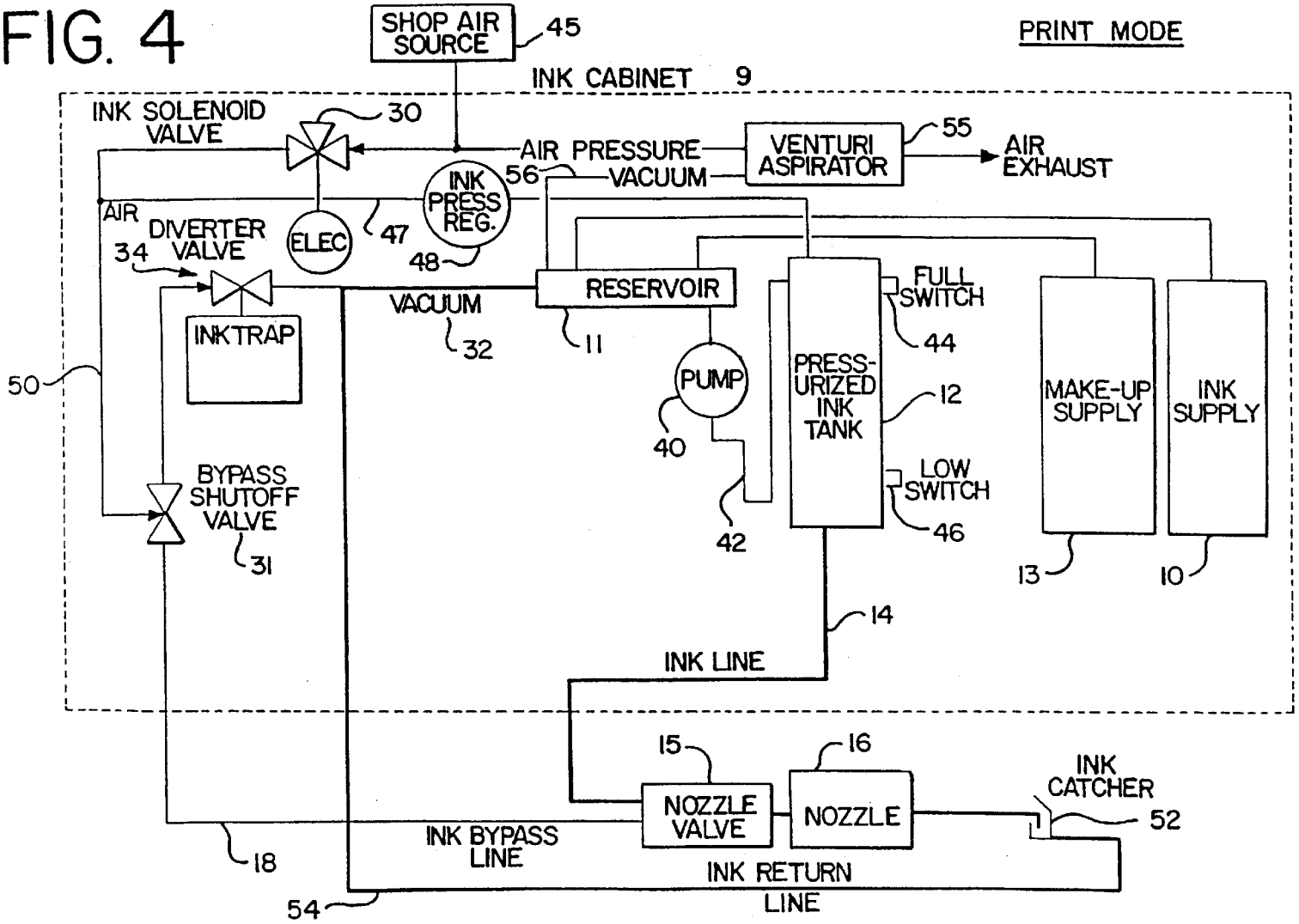
FIG. 4 shows an inkjet printer according to the present invention operating in the normal printing mode.
Figure 5:
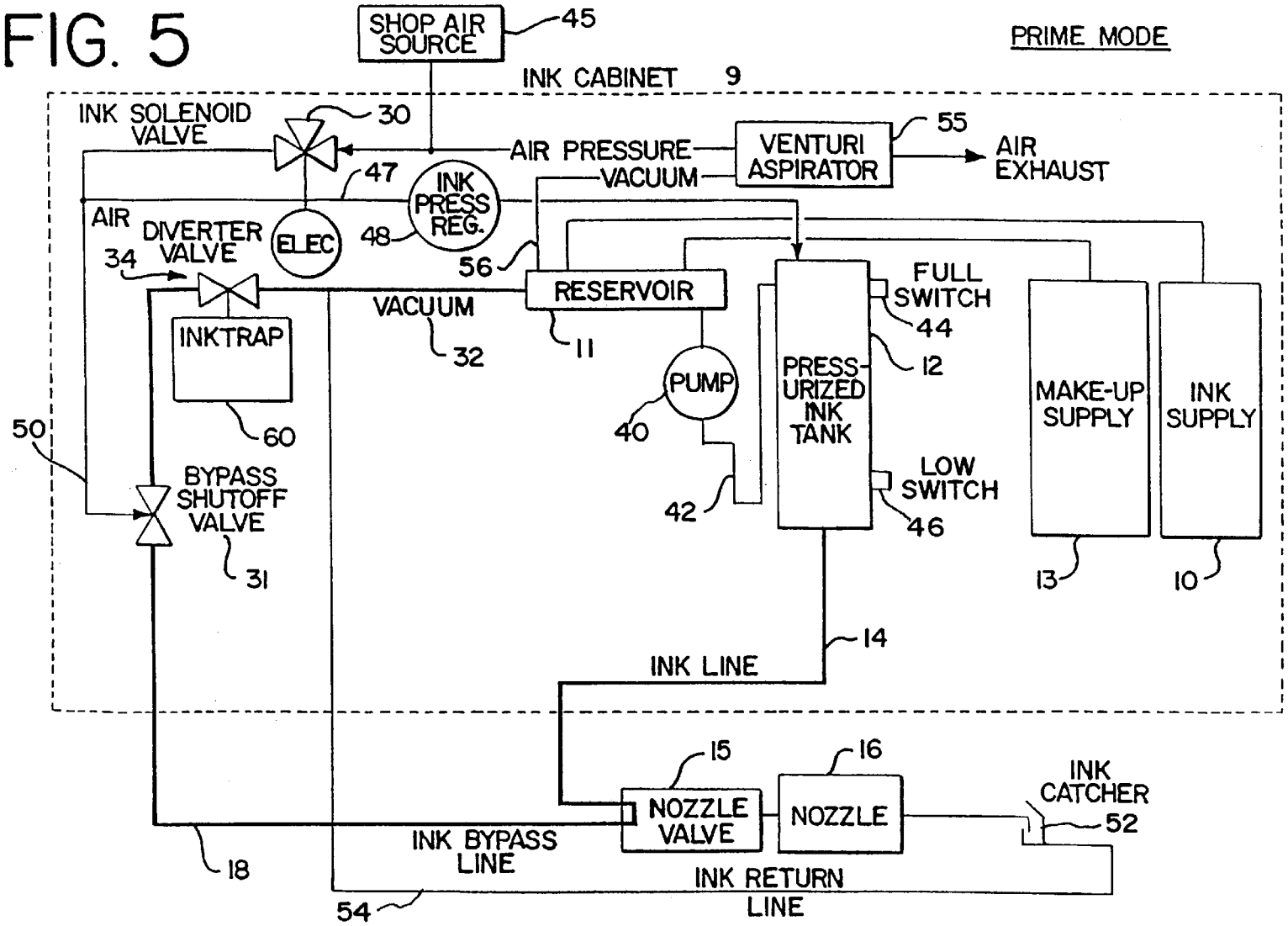
FIG. 5 is a view of the system of FIG. 4 in the auto prime mode according to the present invention.

Referring to FIGS. 4 and 5 an ink jet printer according to the improvements of the present invention is illustrated. FIG. 4 illustrates the system during normal operation where ink is being used for printing on a substrate. FIG. 5 illustrates the same system during a refresh, purge and/or priming operation. Housed in the ink cabinet 9 is an ink supply 10 and a solvent or make-up supply 13. Ink and make-up solvent are provided to a reservoir 11 contained within the ink cabinet. The liquid in reservoir 11 is provided to a pressurized ink tank 12 by means of a pump 40 and line 42. The level of fluid in the tank is monitored by switches 44 and 46 which signal full and low conditions respectively.

Tank 12 is pressurized above atmospheric pressure for normal printing operations by an air source 45 via an electronically controlled solenoid valve 30, via line 47, and pressure regulator 48. Pressurized air is also supplied to the by-pass shut-off valve 31 via line 50.

The output from the pressurized ink tank 12 is supplied via line 14 (the printhead umbilical) to the printhead nozzle valve 15 and then to the nozzle 16. As is well known in this art, the pressurized ink is expelled through the nozzle via an outlet orifice to form a stream of ink. As the ink passes through the orifice, a stimulation energy is applied thereto causing the ink stream to break up into droplets shortly after leaving the nozzle. As the droplets form, certain of them are electrically charged for deflection onto a substrate. The remaining, uncharged drops, pass into an ink catcher 52 for eventual return via line 54 to the reservoir 11. Line 54 is under vacuum pressure (below atmospheric pressure) for that purpose. The vacuum pressure is supplied from the Venturi Aspirator source 55 via line 56 and reservoir 11.

As illustrated in FIG. 4 the normal printing conditions cause pressurized ink in tank 12 to flow via line 14 through the nozzle valve 15 to the nozzle 16 and out of the nozzle via the outlet orifice. Uncharged drops are returned via line 54 to the reservoir 11. This fluid flow path is emphasized by use of heavy lines in the drawing. During such operation, the solenoid valve 30 is open so that air pressure from source 45 is supplied via line 47 to pressurize tank 12 and via line 50 to the shut-off valve 31 thereby keeping it closed. An alternative construction, suitable for use with the present invention, provides a nozzle 16 which has incorporated therein the equivalent of nozzle valve 15. That is, the nozzle includes the valve function at its input end.

Referring to FIG. 5, the system is illustrated operating in its purge, prime and refresh mode. In this mode, which is initiated by the change of state of solenoid valve 30, no air pressure is supplied to the tank 12. Thus, pressure source 45 is blocked by closing solenoid valve 30. This also blocks air pressure from shut-off valve 31 permitting this valve to open. Under these circumstances, the fluid in tank 12 is not pressurized. Nevertheless, it flows through ink line 14 to nozzle valve 15 (or a nozzle with an integral valve). From there, it enters the ink bypass line 18 connected thereto which conveys it, via the now open valve 31, to a diverter valve 34. Diverter valve 34 permits the fluid in line 18 to be provided to an ink trap 60 or back to reservoir 11. This permits the ink to be reused if desired or discarded by diverting it to the ink trap 60. The vacuum required to suck ink from tank 12 through the line 14 and nozzle valve 15 and back to the reservoir 11 is supplied via line 56 from the vacuum source 55.

When operating as illustrated in FIG. 5, it will be apparent that the principal objects of the invention are achieved. It is no longer necessary to manually disassemble the printhead by removing its cover (FIG. 1), nor is it required to manually attach a bleed tube to the bleed port of the nozzle valve 15 as was the case with the manual procedure of the prior art (FIG. 2A). In addition, it is no longer necessary to readjust the ink stream to direct it above the catcher during the process as illustrated for the prior art system in FIGS. 2 and 3. All of these steps and the resultant cost, time and inconvenience are avoided by the present invention. Instead, whenever it is desired to refresh, purge and/or prime the ink system, all that is necessary is that the ink solenoid valve 30 be operated to shut off the air supply to the pressurized ink tank 12. This in turn opens the bypass shut-off valve 31 and allows the vacuum source to suck ink from the tank 12 via line 14, through the nozzle valve 15 and ink bypass line 18. This quickly and efficiently purges any trapped air in the ink line, primes the ink line 14 so that the printer is ready for printing and returns the ink used for this purpose to the reservoir 11 for further use during printing or, if desired, for example in the event that the ink has become contaminated, diverts it to an ink trap 60.

Figure 6:
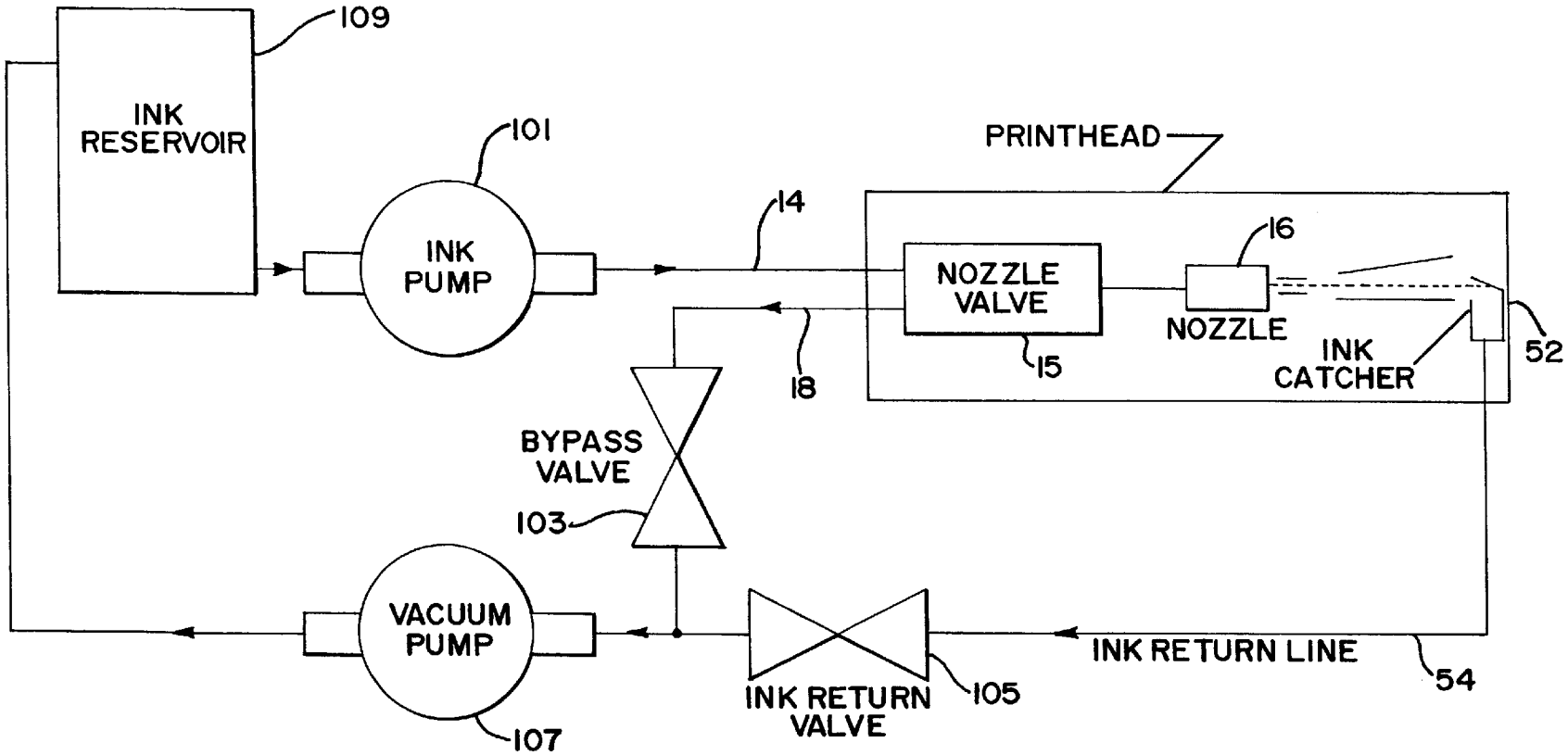
FIG. 6 shows an alternative ink jet printer according to the present invention.

In an alternative ink jet printer shown in FIG. 6, an ink pump 101, vacuum pump 107 and ink reservoir 109 have been added and the shop air source 45, solenoid valve 30, pressure regulator 48, pressurized ink tank 12, vacuum source 55 and reservoir 11 of FIGS. 4 and 5 have been removed. The components of the printheads that are the same in FIG. 6 and FIGS. 4 and 5 are denoted using the same reference numerals.

In this presently preferred embodiment, when operating in its printing mode, the following settings are adopted by the printer of FIG. 6: ink pump 101 is on; bypass valve 103 is closed; ink return valve 105 is open; and vacuum pump 107 is on. Thus, ink pump 101 pressurizes the ink between it and the nozzle valve 15, opening the nozzle valve and forcing ink out through the orifice of nozzle 16. Unused ink enters ink catcher 52, and is drawn by the vacuum generated by vacuum pump 107, along ink return line 54 and through ink return valve 105 to return to ink reservoir 109. Since bypass valve 103 is closed, the suction developed by vacuum pump 107 is not applied to ink bypass line 18.

When operating in its priming mode, the following settings are adopted by the printer of FIG. 6: ink pump 101 is off, bypass valve 103 is open; ink return valve 105 is closed; and vacuum pump 107 is on. Thus, vacuum pump 107 draws ink from reservoir 109 through ink pump 101 (pump 101 may be a gear pump), through the nozzle valve 15, along ink bypass line 18, and through bypass valve 103 to return reservoir 109. Since ink return valve 105 is closed, the suction developed by vacuum pump 107 is not applied to ink return line 54.

As indicated, a significant advantage of the invention is that by using a vacuum source to pull ink through the system instead of pressurized air to push the ink, as is the case during printing, no additional air is entrained in the ink supply and there is none to become entrapped within the ink system or the printhead. Furthermore, during the priming operation, any trapped air which is present will tend to be removed ensuring superior printing operation.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed:

1. A priming system for an ink jet printer of the type including a remote printhead including a nozzle (16) having an inlet and an outlet from which droplets are projected, an ink catcher (52), an ink line (14) for conveying pressurized ink from an ink supply (11, 12 or 109) to said nozzle inlet; a return line (54) for conveying ink from said catcher back to said supply, said priming system comprising:

a nozzle valve (15) having an inlet and an outlet, said nozzle valve outlet being connected to said nozzle inlet;

a bypass line (18) connected to said nozzle valve inlet and to said ink supply (11, 12 or 109); and a source (30, 31, 55 or 103, 107) of below atmospheric pressure (vacuum) connected to said bypass line (18) to draw ink from said nozzle valve inlet, through said bypass line, back to the ink supply (11, 12 or 109);

whereby the ink jet printer may be primed with ink and substantially purged of air by drawing a vacuum in the bypass line to cause ink to flow from the ink supply, through the ink line to the nozzle valve inlet and back to the supply via the bypass line without passing through said nozzle.

2. The system of claim 1 wherein said source of below atmospheric pressure includes a bypass valve (31,103) in circuit with said bypass line (18).

3. The system of claim 1 wherein said ink supply includes a pressurized ink supply (12) and said source of below atmospheric pressure (30, 31, 55) also depressurizes the pressurized ink supply (12).

4. The system of claim 1 wherein said source of below atmospheric pressure includes a bypass valve (31) in circuit with said bypass line (18) and a control valve (30) which operates said bypass valve (31) to prevent ink flow in the bypass line during normal printer operation and to permit ink flow in the bypass line for priming the printer.

5. The system of claim 1 wherein said source of below atmospheric pressure includes a vacuum pump (107) in communication with said bypass line (18).

6. The system of claim 1 further comprising a pump (101) for pumping ink from the ink supply (109) to the nozzle value inlet, and said source of below atmospheric pressure including a bypass valve (103) in circuit with said bypass line (18) and an ink return valve (105) located in the return line (54) for preventing the below atmospheric pressure applied to said bypass line from being applied to the return line.

7. The system of claim 1 wherein said nozzle valve (15) directs ink to said bypass line (18) only when vacuum is applied to said bypass line.

8. A priming system for an inkjet printer of the type including a remote printhead including a nozzle (16) having an inlet and an outlet from which droplets are projected, a nozzle valve (15) for supplying ink to said inlet, and an ink catcher (52); an ink line (14) for conveying pressurized ink from an ink supply (11, 12 or 109) to said nozzle valve; a return line (54) for conveying ink from said catcher back to said supply, said priming system comprising:

a bypass line (18) connected from said nozzle valve back to said ink supply (11, 12 or 109); and a source (30, 31, 55 or 103, 107) of below atmospheric pressure (vacuum) connected to said bypass line (18) to draw ink supplied to said nozzle valve (15) through said bypass line and back to the ink supply (11, 12 or 109) without passing through said nozzle outlet;

whereby the ink jet printer may be primed with ink and substantially purged of air by drawing a vacuum in the bypass line to cause ink to flow from the ink supply, through the ink line to the nozzle valve and back to the supply via the bypass line.

9. The system of claim 8 wherein said source of below atmospheric pressure includes a bypass valve (31, 103) in circuit with said bypass line (18).

10. The system of claim 8 wherein said ink supply includes a pressurized ink supply (12) and said source of below atmospheric pressure (30, 31, 55) also depressurizes the pressurized ink supply (12).

11. The system of claim 8 wherein said source of below atmospheric pressure includes a bypass valve (31) in circuit with said bypass line (18) and a control valve (30) which operates said bypass valve (31) to prevent ink flow in the bypass line during normal printer operation and to permit ink flow in the bypass line for priming the printer.

12. The system of claim 8 wherein said source of below atmospheric pressure includes a vacuum pump (107) in communication with said bypass line (18).

13. The system of claim 8 further comprising a pump (101) for pumping ink from the ink supply (109) to the nozzle valve (15), and said source of below atmospheric pressure including a bypass valve (103) in circuit with said bypass line (18) and an ink return valve (105) located in the return line (54) for preventing the below atmospheric pressure applied to said bypass line from being applied to the return line.

14. The system of claim 8 wherein said nozzle valve (15) directs ink to said bypass line (18) only when vacuum is applied to said bypass line.

15. In combination:

an ink jet printer of the type including a remote printhead including a nozzle (16) having an inlet and an outlet from which droplets are projected, an ink catcher (52), an ink line (14) for conveying pressurized ink from an ink supply (11, 12 or 109) to said nozzle inlet, and a return line (54) for conveying ink from said catcher back to said supply; and a priming system for said printer comprising a nozzle valve (15) having an inlet and an outlet, wherein said valve outlet is connected to said nozzle inlet, a bypass line (18) connected to said nozzle valve inlet and to said ink supply, a source (30,31,55 or 103, 107) of below atmospheric pressure (vacuum) connected to said bypass line to draw ink from said nozzle valve, through said bypass line, back to the ink supply without passing through said nozzle whereby the ink jet printer may be primed with ink and substantially purged of air by drawing a vacuum in the bypass line to cause ink to flow from the ink supply, through the ink line to the nozzle valve and back to the supply via the bypass line.

16. The system of claim 15 wherein said source of below atmospheric pressure includes a bypass valve (31, 103) in circuit with said bypass line (18).

17. The system of claim 15 wherein said ink supply includes a pressurized ink supply (12) and said source of below atmospheric pressure (30, 31, 55) also depressurizes the pressurized ink supply (12).

18. The system of claim 15 wherein said source of below atmospheric pressure includes a bypass valve (31) in circuit with said bypass line (18) and a control valve (30) which operates said bypass valve (31) to prevent ink flow in the bypass line during normal printer operation and to permit ink flow in the bypass line for priming the printer.

19. The system of claim 15 wherein said source of below atmospheric pressure includes a vacuum pump (107) in communication with said bypass line (18).

20. The system of claim 15 further comprising a pump (101) for pumping ink from the ink supply (109) to the nozzle value, and said source of below atmospheric pressure including a bypass valve (103) in circuit with said bypass line (18) and an ink return valve (105) located in the return line (54) for preventing the below atmospheric pressure applied to said bypass line from being applied to the return line.

* * * * *